US005307250A

United States Patent [19]

Pearson

[11] Patent Number: 5,307,250

[45] Date of Patent: Apr. 26, 1994

[54] LIGHT-UP COASTER FOR BEVERAGE CONTAINERS

[76] Inventor: Stephen J. Pearson, 34520 N. Hickory Ct., Ingleside, Ill. 60041

[21] Appl. No.: 57,507

[22] Filed: May 4, 1993

[51] Int. Cl.[5] ..... F21V 33/00

[52] U.S. Cl. ..... 362/101; 362/154; 362/394; 362/802; 200/85 R; 248/346.1

[58] Field of Search ..... 362/101, 154, 394, 802; 116/227, 228; 200/308, 85 R, DIG. 35, 61.2; 248/346.1

[56] References Cited

U.S. PATENT DOCUMENTS

| | | | |
|---|---|---|---|
| 4,336,574 | 6/1982 | Goodman | 362/101 |
| 4,344,113 | 8/1982 | Ditto et al. | 362/101 |
| 4,858,084 | 8/1989 | Sheryll | 362/101 |

FOREIGN PATENT DOCUMENTS

| | | | |
|---|---|---|---|
| 230685 | 2/1911 | Fed. Rep. of Germany | 248/346.1 |
| 309529 | 11/1918 | Fed. Rep. of Germany | 248/346.1 |
| 98753 | 4/1923 | Switzerland | 248/346.1 |

*Primary Examiner*—Ira S. Lazarus
*Assistant Examiner*—Sara S. Raab
*Attorney, Agent, or Firm*—Milton S. Gerstein

[57] ABSTRACT

A light-up coaster for beer bottles, and the like, has an outer housing in which is vertically-slidable an inner housing. The upper surface of the inner housing is used to support a bottle thereon, and a spring biases the inner housing upwardly. A pair of switches are controlled by the movement of the inner housing. The first switch is a normally-closed switch, and the second switch is a normally open switch. The two switches are arranged in series with a light bulb and battery power-source. When there is no bottle supported on the upper surface of the inner housing, the upper surface of the inner housing is raised by the spring to its highest level and into abutting contact with an interior, upper, annular lip of the outer housing. In this state, the first switch is closed but the second switch is open. When a full bottle of beer, or the like, is supported on the upper surface of the inner housing, the inner housing is lowered against the force of the spring, and the first switch is open and the second switch is closed. When the bottle is empty, then the inner housing is raised slightly to close the first switch again but still keeping the second switch in its closed state, whereby the light bulb is illuminated.

19 Claims, 4 Drawing Sheets

LIGHT-UP COASTER FOR BEVERAGE CONTAINERS

BACKGROUND OF THE INVENTION

The present invention is directed to a coaster for a bottle, can, or mug of beverage, such as beer or ale. The conventional coaster is placed under a beer bottle, or the like, in order to prevent the slipping or sliding the bottle on the supporting surface, and to catch and retain liquid condensation or any minor spillage that may occur. There is known to provide a coaster that is continuously lit up, in order to provide an aesthetic effect.

The present invention is directed to a coaster that is lit up only when the bottle of beer, or the like, supported thereon is empty or near-empty, in order to inform the bartender, or the like, of the need to approach the customer or person to see if he or she wishes another, full bottle.

SUMMARY OF THE INVENTION

It is, therefore, the primary objective of the present invention to provide a coaster for beer bottles, cans, mugs, and the like, which lights up only when the bottle is empty or near-empty, in order to inform the bartender, or the like, of the need to approach the customer or person to see if he or she wishes another, full bottle.

It is another objective of the present invention to provide such a coaster that is universally acceptable to all makes or brands of bottles beer, or the like, that are of the same size.

It is still another objective of the present invention to provide such a coaster that may be designed to support and light up when supporting empty bottles, mugs or cans by adjusting the spring-tension.

Toward these and other ends, the light-up coaster for beer bottles, and the like, comprises a main, outer housing in which is vertically-slidable an inner housing. The upper surface of the inner housing is used to support a bottle thereon, and a spring biases the inner housing upwardly. A pair of switches are controlled by the movement of the inner housing. The first switch is a normally-closed switch, and the second switch is a normally open switch. The two switches are arranged in series with a light bulb and battery power-source. When there is no bottle, at all, supported on the upper surface of the inner housing, the upper surface of the inner housing is raised by the spring to its highest level and into abutting contact with an interior, upper, annular lip of the outer housing. In this state, the first switch is closed but the second switch is open. When a full bottle of beer, or the like, is supported on the upper surface of the inner housing, the inner housing is lowered against the force of the spring, and the first switch is open and the second switch is closed. When the bottle is empty, then the inner housing is raised slightly to close the first switch again but still keeping the second switch in its closed state, whereby the light bulb is illuminated. In a modification, the tension provided by the spring is adjustable, in order to tailor the coaster to a specific group-type of container, such as bottles, cans, or mugs.

BRIEF DESCRIPTION OF THE DRAWINGS

The invention will be more readily understood with reference to the accompanying drawing, wherein.

DETAILED DESCRIPTION OF THE INVENTION

Figure 3:
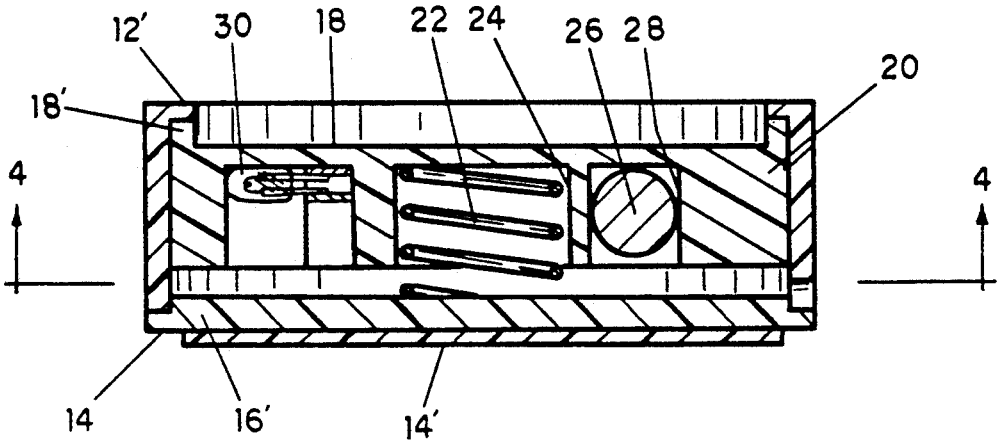
FIG. 3 is a cross-sectional view taken along line 3—3 of FIG. 2.
Figure 4:
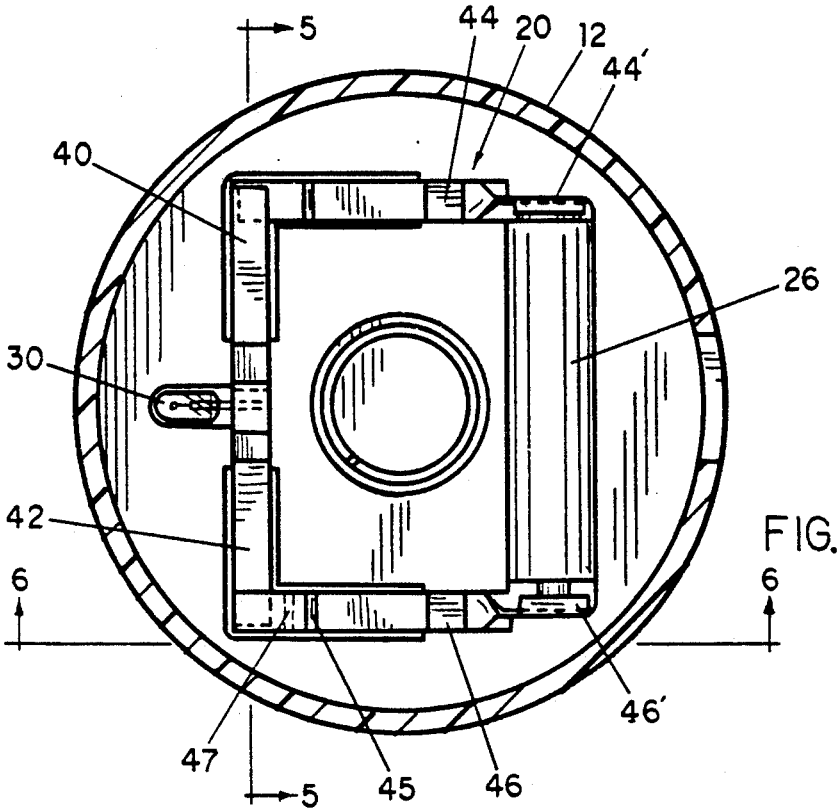
FIG. 4 is a cross-sectional view taken along line 4—4 of FIG. 3.
Figure 5:
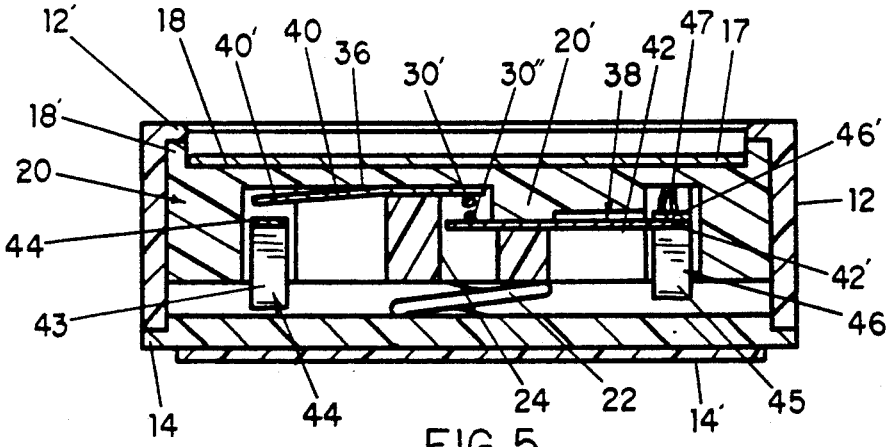
FIG. 5 is a cross-sectional view taken along line 5—5 of FIG. 4, showing the coaster with no bottle thereon, so that the coaster is not lit up.
Figure 6:
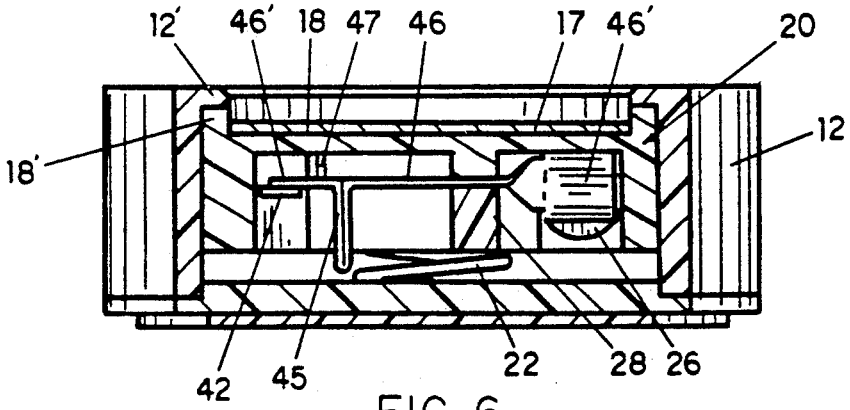
FIG. 6 is a cross-sectional view taken along line 6—6 of FIG. 4.

Referring now to the drawings in greater detail, the light-up coaster of the invention is indicated generally by reference numeral 10. The light-up coaster 10 has a generally disc-shaped, outer main housing 12 defining a bottom support-surface 14, and an annular, vertical, side wall-surface 16. The bottom support-surface 14 has an inwardly-protecting, smaller-diameter annular ring 16' that fits inside the bottom opening of the annular, vertical, side wall-surface 16, as seen in FIGS. 3, 5 and 6, in order to allow for the assembly of the coaster. The bottom surface 14 has secured thereto a retaining pad 14', such as a circular pad of double-sided tape in order to firmly retain the coaster 10 on a counter-surface, such as that of bar. Mounted inside the outer housing 12 is an inner housing 20 that is vertically slidable in the outer housing 12, as can be seen by comparing FIGS. 7 and 8. The inner housing has a vertically-reciprocable top, or upper, support-surface 18, upon which is supported a bottle, can, or mug of beer, or the like. The outer housing 12 has an upper, interior, annular lip 12', while the upper support-surface 18 has a cooperating, upwardly-extending, annular wall 18'. The annular lip 12' provides a limit-stop to the upward movement of the upper support-surface 18, and, therefore, to the entire inner housing 20, as can be seen in FIGS. 3, 5 and 6, which state occurs when no bottle or can is positioned on the coaster. This construction also ensures that the upper support-surface 18 is recessed, so that the combination of the annular lip 12' and the annular wall 18' provide a circumferential retaining wall to the bottom part of the bottle positioned thereat, in order to provide greater stability and prevent accidental tipping of the bottle, especially when the bottle is full, since the inner housing is depressed, providing even greater stability. The inner housing 20 is biased upwardly by a coil spring 22, which is received in a central well 24 of the inner housing 20, as best seen in FIG. 3. The coil spring 22 has an upper end that abuts against the bottom of the upper surface 18, and a lower end that abuts against the upper surface of the bottom support-surface 14, whereby the inner housing is constantly biased upwardly. Also provided is a power source, or battery, 26 mounted in a radially-offset well, or compartment, 28, and a light source, or bulb, 30 mounted diametrically-opposite to the well 28.

Figure 7:
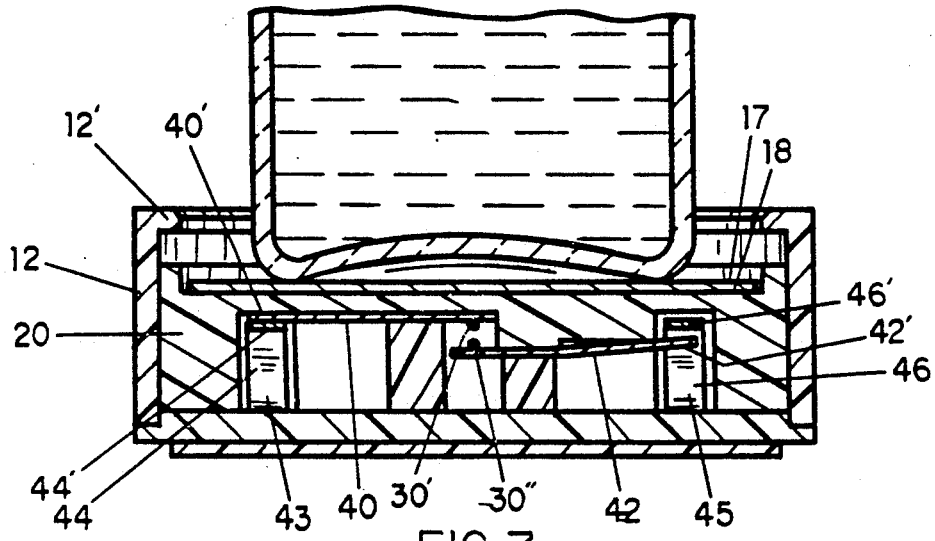
FIG. 7 is a cross-sectional view similar to FIG. 5, but showing the coaster with a full or partially-full bottle thereon, so that the coaster is not lit up.

Refer now to FIGS. 4–8. FIGS. 5 and 6 show the coaster in its state without a bottle, or the like, supported on the upper surface 18, in this case, the light bulb 30 is not illuminated, as will be explained hereinbelow. The inner housing 20, also, mounts a pair of switch elements 36, 38 in wells. Switch 36 is a normally-open switch, while the switch 38 is a normally-closed switch. The switch 36 includes a metal-spring contact-arm 40, while the switch 38 includes a metal-spring contact-arm 42. The metal-spring contact-arm 40 is a bent-piece of metal that normally bends downwardly in its free state, as seen in FIG. 5, and is mounted to the downwardly-extending, stepped portion 20′ of the inner housing 20 in cantilever fashion. The other contact-arm 42 is also bent, but in the opposite sense, so that, in its free state, the contact-arm 42 bends upwardly, as seen in FIG. 7, and it is mounted to the underside of the upper surface 18, also in cantilever fashion. This bent shape of each contact-arm tends to cause each contact-arm to assume a closed state with its opposite, mating contact, as described below. Thus, movement of the inner housing in the outer housing moves these contact-arms therewith, along with the battery and power source. The inner end of the contact-arm 40 is in electrical contact with one electrode 30′ of the light bulb 30, while the inner end of the other contact-arm 42 is in electrical contact with the other electrode 30″ of the light bulb.

Figure 8:
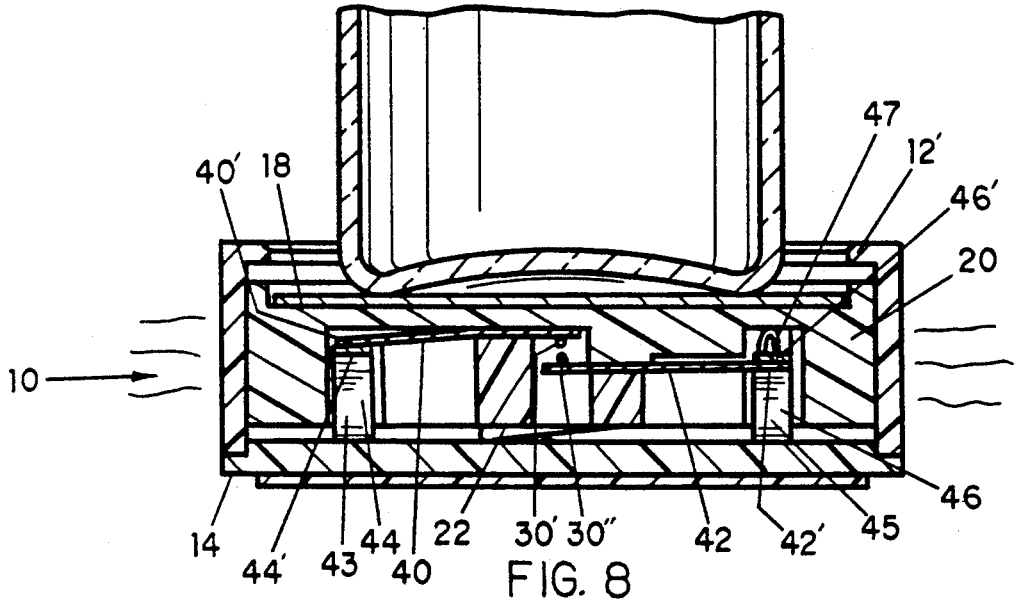
FIG. 8 is a cross-sectional view similar to FIG. 5, but showing the coaster with an empty, or near-empty, bottle thereon, so that the coaster is lit up.
Figure 9:
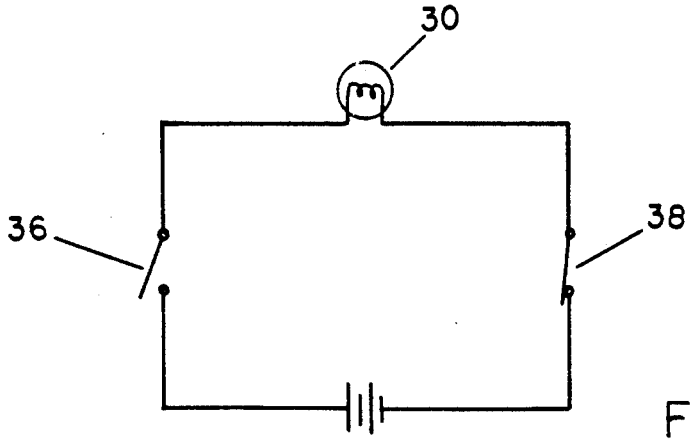
FIG. 9 is an electrical schematic of the two switches housed in the coaster for actuating a light source only when an empty or near-empty bottle is supported on the coaster.

Electrically coupling the contact-arm 40 to the negative terminal of the battery power-source 26 is a first contact-strip 44, and electrically coupling the contact-arm 42 to the positive terminal of the battery power-source 26 is a second contact-strip 46. Each contact-strip 44, 46 is a thin, flat, spring-steel plate also mounted in wells in the inner housing, as seen in FIGS. 7 and 8. Each contact-strip 44, 46 defines an enlarged, planar end 44′, 46′, respectively, for contact against a respective electrode of the battery. As can be seen in FIGS. 5, 7 and 8, the end 40′ of the contact-arm 40 lies vertically above the end 44′ of its corresponding contact-strip 44, while the end 42′ of the contact-arm 42 lies vertically below the end 46′ of its corresponding contact-strip 46 for reasons set forth hereinbelow. Each contact-strip 44, 46 is also provided with a doubled-over, camming section 43, 45, respectively. The camming section 43 of the contact-strip 44 is used for contacting the upper surface of the bottom wall 14 for effecting the straightening out of the contact-arm 40, as described hereinbelow, while the doubled-over section 45 is also downwardly-extending for contact against the upper surface of the bottom wall 14. The contact-strip 46 also has another, smaller, doubled-over camming section 47 in order to ensure that the contact between the ends 46′ and 42′ remains sure, which camming section 47 contacts the undersurface of the upper surface 18, as seen in FIGS. 5 and 8.

As can be seen in FIGS. 5 and 6, in the unused state of the coaster 10, with not bottle thereon, the inner housing 20 is biased into its upwardly-most position, where the annular surfaces 12′ and 18′ are in abutting contact. In this state, the end 40′ of the contact-arm 40 is spaced above the juxtapositioned end 44′ of the contact-strip 44, so that this switch is open, and no current is provided to the bulb 30. In this state, the end 42′ of the contact-arm 42 is in abutting contact with the end 46′, whereby the contact-strip forces the contact-arm 42 into a straight configuration, overcoming the normally, upwardly-bent shape thereof. The doubled-over camming sections 43, 45 are raised out of contact with the bottom wall 14.

Referring to FIG. 7, the coaster 10 is shown with a full, or partially-full, bottle of beer, or the like, thereon. The weight of the bottle forces the inner housing 20 downwardly within the outer housing 12, partially overcoming the bias of the spring 22. The movement of the inner housing causes the lower ends of the doubled-over camming sections 43, 45 to contact the bottom wall 14, whereby the camming section 43 is forced upwardly relative to the contact-arm 40 as the inner housing is lowered, thereby closing the contact between the end 40′ of the contact-arm 40 and the end 44′ of the contact-strip 44. However, at the same time, the end 42′ of the contact-arm 42 is brought out of contact with the end 46′ of the contact-strip 46, since the doubled-over camming section 45 raises the end 46′ relative to the end 42′, against the bias of the doubled-over section 47 that abuts the underside of the upper support-surface 18, whereby this switch opens, to thereby keep the circuit open, so that no current flows to the light bulb.

FIG. 8 shows an empty bottle on the coaster 10. In this state, both switches will be closed, in order to provide current to the bulb to illuminate it. When the bottle is empty, or close to empty, the weight thereof only partially overcomes the biasing force of the spring 22, which raises the inner housing 20 relative to the outer housing as compared with its state when a full bottle is supported thereon, so that the end 42′ is now brought into contact with the end 46′ of the contact-strip 46, since there is no overcoming force to the doubled-over section 47. This is so, because, as the inner housing rises, the end 42′ of the contact 42 will abut the end 46′ of the contact-strip 46, since the force on the camming section 45 will have been almost completely removed by this upward movement of the inner housing, until the point that the bottom trough of the camming section 45 just touches the bottom wall 14. At the same time, the end 40′ of the contact-arm 40 will remain in contact with the end 44′ of the contact-strip 44 by the fact that the doubled-over camming section 43 is still forced upwardly by the bottom wall 14 to thereby force the end 44′ upwardly relative to the end 40′. When the bottle is removed, the inner housing is forced back up to its uppermost position, whereby the camming section 43 is lifted up from contact with the bottom wall, so that the end 44′ may move downwardly relative to the end 40′, thereby opening contact and returning the device to the state shown in FIG. 5. It is noted that the camming section 43 is mounted somewhat lower than the camming section 45, as seen in FIG. 5, so that the camming section 44 is still pushes up its end 44′ even though the camming section 45 does not push its end upwardly, so that the intermediate state of FIG. 8 is achieved. The bent-nature of the contact-arms ensures that each switch is closed for two states of the device, and open for one state. The closed states for the switch 36 occurs whenever a bottle is supported on the coaster, while its open state occurs whenever there is no bottle supported. For the switch 38, the one state of being open occurs only when a full bottle is supported, while the two closed states occurs when there is an empty bottle, or no bottle, supported.

Figure 1:
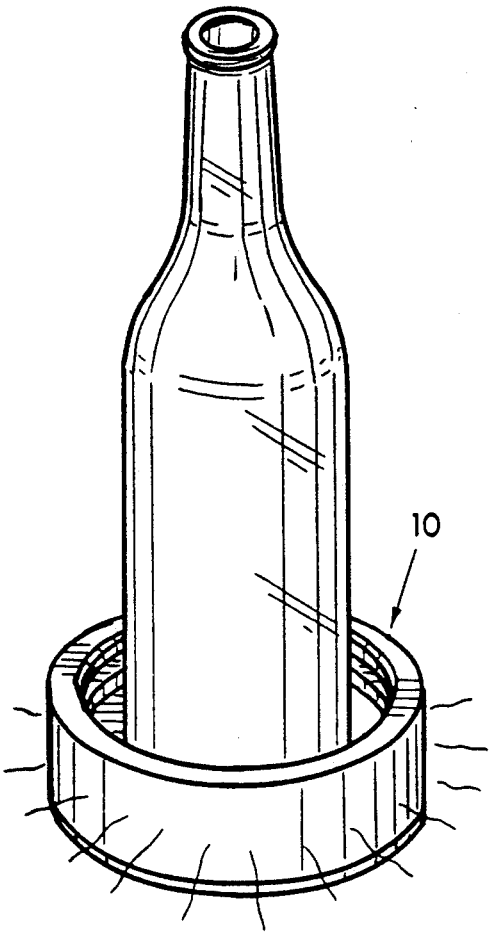
FIG. 1 is an isometric view of the light-up coaster of the invention with an empty bottle thereon that causes the coaster to light up.
Figure 2:
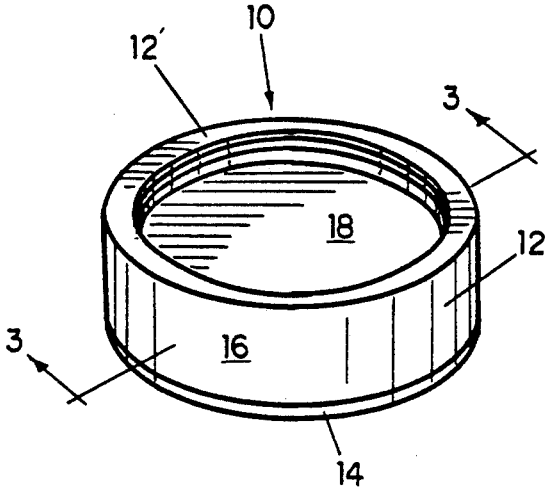
FIG. 2 is an isometric view of the light-up coaster without a bottle thereon, with the coaster unlit.
Figure 10:
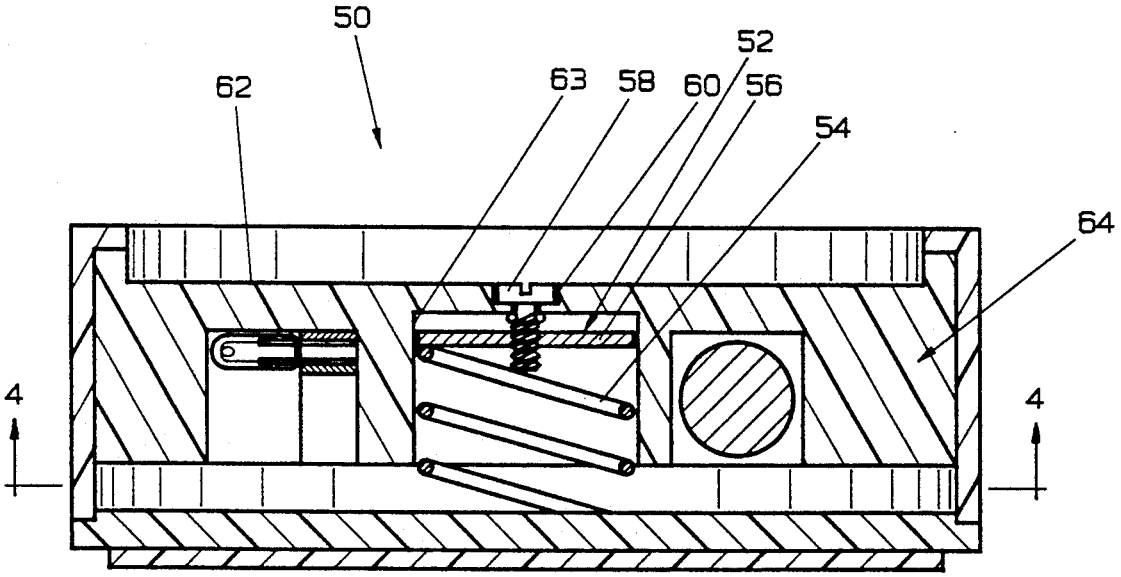
FIG. 10 is a cross-sectional view similar to FIG. 3 showing a modification in which there is provided a variable-tension spring which allows the coaster of the invention to be adapted to support different containers, such as bottles, cans, mugs of different weight.

FIG. 10 shows a modification 50 of the invention in which a variable-tension spring-assembly 52 is provided. The variable-tension spring assembly has a coil spring 54 similar to the spring 22. Mounted in rectilinear-shape well 63 of the inner housing 64 is a movable, rectilinear-shaped plate 56, which receives through a central hole thereof the threaded shank of a screw 58. The screw 58 extends through an aligned hole 60 in the center of the upper surface 62 of the inner housing 64. As the screw 58 is rotated in one direction or the other, the plate 56 will be moved up or down, in order to decrease or increase the biasing force provided by the spring 54 on the inner housing. Thus, if it is desired, for example, to support on the upper surface 62 a mug of beer which weighs more than the full bottle of FIG. 1., then the screw 58 will be rotated in order to lower the plate 56 in order to compress the spring 54 to adjust its tension for a heavier container.

In the preferred form of the invention, the outer housing of the coaster is approximately one inch high, with an outside diameter of approximately three inches. Except for the switches and battery, the coaster is made of translucent, hard plastic, such as acrylic or crystal styrene. While a bottle has been shown as being the product that is supported, which bottle is typically an eight-ounce bottle, the coaster may be used to support mugs, glasses, or cans, with the bias of the spring 22 being changed in order to accommodate the specific weight associated with the mug or can. For example, for a twelve-ounce can, the bias of the spring will be increased accordingly. The spring 22 for use when bottles are supported, is preferably a steel spring with a diameter 13/16 in. with gauge wire of 0.047 in., with an overall, relaxed height of ¾ in. In the embodiment illustrated, the spring's upper end travels approximately 3/32 in. Each contact-arm and each contact-strip is preferably made of stainless steel approximately 0.005 in. thick and ⅛ in. wide. If desired, a standard cardboard coaster 17, as seen in FIGS. 6 and 7 may be placed on the upper support-surface 18, in the recessed area, which helps to protect the device 10 from spilled liquid or condensation. Also, drain holes may be provided in the bottom support-surface 14 in order to allow any spilled liquid that has entered into the interior of the device to be drained. It is, also, noted that a version of the coaster of the invention may be provided without the electrical circuitry, power source, and light bulb. This version would retain the advantages of the invention directed to retaining the bottle of beer, or the like, in a much more stable and steady manner, which prevents spillage and the tipping over of the bottle, or the like. It is also possible to provide a version which, instead of actuating a light source, an electrical signal is sent to a central control board, which control board would have inputs from a number of similar coasters of the invention.

It is also within the purview of the invention to provide a totally mechanical indicator instead of the electrical circuitry above-described. In such an modification, the movement of the inner housing inside the outer housing to a position when an empty bottle is supported will trip a mechanical actuator rather than the switches 36, 38.

While a specific embodiment of the invention has been shown and described, it is to be understood that numerous changes and modifications may be made therein without departing from the scope, spirit and intent of the invention as set forth in the appended claims.

What I claim is:

1. A device for supporting a can, mug, bottle, and can comprising:

an outer housing having a hollow interior comprising an annular, side wall-surface, an open upper end, and a bottom;

an inner housing slidably mounted in said outer housing comprising an annular, side wall-surface, and an upper support-surface;

biasing means mounted in said outer housing for upwardly biasing said inner housing in said outer housing;

electrical-circuit means comprising a power source, normally-unactuated output means, and switch means for selectively closing the connection between said power source and said output means in order to generate a signal, said switch means comprising means for closing the connection between said output means and said power source in response to the position of said inner housing in said outer housing;

said means for closing the connection between said output means and said power source causing said output means to be actuated when said position of said inner housing is raised a specific distance within said outer housing by said biasing means in response to one of an empty container and near-empty container being supported on said upper support-surface, and causing said output means to be unactuated for all other positions.

2. The device according to claim 1, wherein said switch means comprises a first, normally-open switch, and a second, normally-closed switch; each said switch taking on three states depending upon the position of said inner housing in said outer housing: One said state being open, and two said states being closed; said switches being in their closed state at the same time only for one general positioning of said inner housing in said outer housing.

3. The device according to claim 2, wherein said first switch means comprises a first contact-arm and a first contact-strip, said first contact strip connecting said first contact-arm to an electrode of said power source when said first switch is closed; said second switch means comprising a second contact-arm and a second contact-strip, said second contact strip connecting said second contact-arm to another electrode of said power source when said second switch is closed.

4. The device according to claim 3, wherein said first contact-arm comprises a first contact-portion and said first contact-strip comprising a second contact portion for contact with said first contact-portion for closing said first switch, said first contact-portion being positioned above said second contact-portion, said first contact-portion being normally spaced from said second contact-portion; said first contact-arm also comprising a third contact portion for connection to an electrode of said output means.

5. The device according to claim 4, wherein said first contact-arm comprising a resilient camming member extending downwardly, said camming member contacting a portion of said outer housing when said inner housing is in an intermediate position in said outer housing, said camming member forcing said second contact-portion upwardly into contact with said first contact-portion to thereby close said first switch.

6. The device according to claim 5, wherein each of said contact-arm and said contact-strip is made of spring metal, said camming member comprising a doubled-over portion of said contact-strip.

7. The device according to claim 4, wherein said first contact-arm comprises a downwardly-bent section that comprises said first contact-portion.

8. The device according to claim 3, wherein said second contact-arm comprises a first contact-portion, and said second contact-strip comprising a second contact portion for contact with said first contact-portion for closing said second switch, said first contact-portion being positioned below said second contact-portion, said first contact-portion being normally in contact with said second contact-portion; said second contact-arm also comprising a third contact portion for connection to an electrode of said output means.

9. The device according to claim 8, wherein said second contact-arm comprises a resilient camming member extending downwardly, said camming member contacting a portion of said outer housing when said inner housing is in a downward-most position in said outer housing, said camming member forcing said second contact-portion upwardly out of contact with said first contact-portion to thereby open said second switch.

10. The device according to claim 9, wherein said second contact-portion of said second contact-strip comprises another resilient camming member for contact against the bottom of said upper support-surface, said another camming member biasing said second contact-portion toward said first contact-portion of said first contact-arm to form said normally-closed second switch.

11. The device according to claim 9, wherein each of said contact-arm and said contact-strip is made of spring metal, each of said camming members comprising a doubled-over portion of said contact-strip.

12. The device according to claim 8, wherein said second contact-arm comprises an upwardly-bent section that comprises said first contact-portion.

13. The device according to claim 1, wherein said outer housing comprises an interiorly-projecting limit member, and said upper support-surface of said inner housing comprising cooperating stop means for abutting against said limit member of said outer housing, whereby, when no container is supported on said upper support-surface, said biasing means forces said inner housing upwardly until said stop means abuts against said limit member.

14. The device according to claim 13, wherein said interiorly-projecting limit member comprises an annular bead at said upper end of said outer housing, said stop means comprising an upstanding annular ring for abutting against said annular bead, whereby said upper support-surface is recessed from said open upper end of said outer housing, whereby a beverage container is supported with greater stability; said output means being a light source.

15. The device according to claim 14, further comprising a coaster supported on said upper support-surface of said inner housing, said coaster being recessed from said open upper end of said outer housing, said coaster absorbing condensation and spillage; said inner housing further comprising means for adjusting the biasing force of said biasing means in order to support full containers of different weight.

16. A device for supporting a can, mug, bottle, and can comprising:

an outer housing having a hollow interior comprising an annular, side wall-surface, an open upper end, and a bottom;

an inner housing slidably mounted in said outer housing comprising an annular, side wall-surface, and an upper support-surface;

biasing means mounted in said outer housing for upwardly biasing said inner housing in said outer housing;

said outer housing comprising an interiorly-projecting limit member, and said upper support-surface of said inner housing comprising cooperating stop means for abutting against said limit member of said outer housing, whereby, when no container is supported on said upper support-surface, said biasing means forces said inner housing upwardly until said stop means abuts against said limit member;

said upper support-surface being recessed from said open upper end of said outer housing, whereby a beverage container is supported with greater stability, the more full the container, the lower said inner housing is positioned in said outer housing, and the greater stabilizing forces provided to retaining the container upright and supported on said upper support-surface;

normally-inactivated output means that is inactivated for most positions of a beverage-container supported on said upper support-surface, that, when activated, indicates a state of said inner housing in said outer housing, said output means being actuated by the movement of said inner housing within said outer housing when said inner housing is located at a specified position within said outer housing; and means for activating said output means when said position of said inner housing is raised a specific distance within said outer housing by said biasing means in response to one of an empty container and near-empty container being supported on said upper support-surface.

17. A method of supporting a beverage-container, and the like, on a coaster, which coaster comprises an outer housing having a hollow interior comprising an annular, side wall-surface, and an open upper end;

an inner housing slidably mounted in the outer housing comprising an annular, side wall-surface, and an upper support-surface;

biasing means mounted in the outer housing for upwardly biasing the inner housing in the outer housing;

a normally-inactivated output means which, when activated, gives off a indication whenever the beverage-container is empty or near-empty, said method comprising:

a) placing a beverage-container that is one of empty and near-empty on the upper support-surface of the inner housing;

b) said step (a) causing the inner housing to descend within the outer housing against the biasing force of the biasing means;

c) said step (b) causing the inner housing to descend within the outer housing a specific distance to a position that activates the output in order to generate an indication that indicates the container is one of empty and near-empty.

18. The method of supporting a beverage-container according to claim 17, further comprising, prior to said step (a):

d) placing a container on the upper support-surface that is one of full and near-full;

e) said step (d) causing the inner housing to descend within the outer housing against the biasing force of the biasing means;

f) said step (e) causing the inner housing to descend within the outer housing a distance greater than that in said step (b) to a position at which the output is not activated.

19. The method of supporting a beverage-container according to claim 18, further comprising g) removing the container from off of the upper support-surface;

h) said step (g) causing the inner housing to ascend within the outer housing by means of the biasing force of the biasing means to an upward-most position in which the output is not activated.

* * * * *